US005114817A

United States Patent [19]

Urano et al.

[11] Patent Number: 5,114,817

[45] Date of Patent: May 19, 1992

[54] CYAN-COLORED PHOTOSENSITIVE TONER CONTAINING ZINC OXIDE

[75] Inventors: Akiyoshi Urano, Takarazuka; Yumiko Sano, Ibaraki, both of Japan

[73] Assignee: Mita Industrial Co., Ltd., Osaka, Japan

[21] Appl. No.: 536,374

[22] Filed: Jun. 11, 1990

[30] Foreign Application Priority Data

Jun. 13, 1989 [JP] Japan ..... 1-150935

[51] Int. Cl.[5] ..... G03G 5/09

[52] U.S. Cl. ..... 430/93; 430/90

[58] Field of Search ..... 430/90, 83, 93

[56] References Cited

U.S. PATENT DOCUMENTS 3,954,467 5/1976 Takimoto et al. ..... 430/90
4,043,813 8/1977 Logue et al. ..... 430/90
4,435,492 3/1984 Suzuki et al. ..... 430/83

*Primary Examiner*—John Goodrow
*Attorney, Agent, or Firm*—Armstrong & Kubovcik

[57] ABSTRACT

Disclosed is a photosensitive toner sensitive to light with wavelengths in the range of 600 to 700 nm, which includes zinc oxide, a sensitizing dye, and a resinous binder. The sensitizing dye is a cyanine dye which is represented by the following general formula (I):

(I)

wherein  is

R is $CH_3$, $C_2H_5$, n-$C_4H_9$, n-$C_7H_{15}$, $CH_2COOH$, $C_2H_4COOH$ or allyl, and X is I, Cl, Br, $NO_3$ or tolylsulfonyl.

3 Claims, 2 Drawing Sheets

CYAN-COLORED PHOTOSENSITIVE TONER CONTAINING ZINC OXIDE

BACKGROUND OF THE INVENTION

1. Field of the Invention

The present invention relates to a cyan-colored photosensitive toner which is sensitive to light having wavelengths in the range of 600 to 700 nm, and more particularly to a photosensitive toner which is mixed with magenta-colored and yellow-colored photosensitive toners for forming a color image by a single exposure and developing operation.

2. Description of the Prior Art

In recent years, a method of forming a color image using photosensitive toners by a single exposure and developing operation has been attracting attention. In such a method, three kinds of photosensitive toners are used which are respectively colored cyan, magenta, and yellow. The photosensitive toners are sensitive to the colors of light complementary to the respective toner colors; i.e., the cyan toner is sensitive to red light, the magenta toner to green light, and the yellow toner to blue light, each becoming conductive when exposed to its complementary light.

The following describes a color image forming process which uses a mixture of the three color photosensitive toners, i.e., a photosensitive toner mixture.

FIG. 2 is a schematic diagram showing the main part of an image forming apparatus using the photosensitive toners mentioned above. The apparatus comprises a mixing chamber 13 in which photosensitive toners 14 of cyan, magenta, and yellow are mixed and contained in prescribed proportions, a sleeve **13*b* and a stirrer 13*c* which are disposed inside the mixing chamber 13, a transparent conductive support drum 16 rotatably mounted adjacent to one side of the mixing chamber 13, a light source unit 30 disposed inside the support drum 16, and a transfer unit 18 to which a voltage of prescribed polarity is applied. The reference numeral 20** indicates a sheet of copy paper.

The mixing chamber 13 contains carrier 15. The three kinds of photosensitive toners 14 fed into the mixing chamber 13 and the carrier 15 already contained therein are stirred together by means of the stirrer **13*c*, thereby electrically charging the photosensitive toners 14 through friction. The thus charged photosensitive toners 14 are delivered together with the carrier 15 to the sleeve 13*b*. Then, the photosensitive toners 14 and the carrier 15 form a magnetic brush while being carried on the surface of the sleeve 13*b* by the rotation thereof. A bias voltage of prescribed polarity is applied to the sleeve 13*b*, so that an electric field is formed between the support drum 16 and the sleeve 13*b***.

The light source unit 30 disposed inside the support drum 16 comprises three light sources, i.e., a green light source 31, a blue light source 32, and a red light source 33, which are capable of outputting light of respective wavelengths to which the respective photosensitive toners 14 in the photosensitive toner mixture are sensitive, the light being emitted toward the surface of the support drum 16 from the respective color light sources 31, 32, and 33.

In the color-image forming process, the photosensitive toners 14 and the carrier 15 form a magnetic brush on the sleeve **13*b* as described above, and then the magnetic brush comes into contact with the support drum 16. At this time, because of the electric field formed between the support drum 16 and the sleeve 13*b*, the charged photosensitive toners 14 move from the sleeve 13*b* onto the support drum 16, so that a layer 17 of the photosensitive toner mixture is formed on the support drum 16. Using the light sources 31 to 33, slit exposure is performed on the photosensitive toner mixture layer 17. In the slit exposure, green light is projected through the support drum 16 onto the areas of the charged photosensitive toner mixture layer 17 that corresponds to the green parts of the image to be formed, causing the magenta toner in the photosensitive toner mixture layer 17** in those areas to become conductive and to lose its electric charge. On the other hand, the yellow and cyan toners do not become conductive and remain charged. Likewise, for the blue areas of the image, blue light is projected onto the charged photosensitive toner mixture corresponding to those areas, causing the yellow toner to become conductive and lose its electric charge, while the cyan and magenta toners remain charged. Furthermore, for the red areas of the image, red light is projected onto the charged photosensitive toner mixture corresponding to those areas, causing the cyan toner to become conductive and lose its electric charge, while the magenta and yellow toners remain charged.

Each photosensitive toner 14 that has thus lost its electric charge moves away from the support drum 16 and back to the sleeve **13*b*. That is. in the areas exposed to the green light, the yellow and cyan toners are held on the surface of the support drum 16. Likewise, in the areas exposed to the blue light, the cyan and magenta toners are held on the support drum 16, and furthermore, in the areas exposed to the red light, the magenta and yellow toners are held on the support drum 16**.

With the rotation of the support drum 16, the charged photosensitive toners still held on the support drum 16 are then brought to the position facing the transfer unit 18, where the toners are transferred onto the copy paper 20 by means of the transfer unit 18 to which a voltage of prescribed polarity is applied. At this time, the yellow and cyan toners adhering to the areas on the support drum 16 exposed to the green light are transferred to the copy paper 20 to impart green color. Likewise, the cyan and magenta toners adhering to the areas on the support drum 16 exposed to the blue light are transferred to the copy paper 20 to give blue color, and furthermore, the magenta and yellow toners adhering to the areas on the support drum 16 exposed to the red light are transferred to the copy paper 20 to give a red color. Thus, a complete color image is formed on the copy paper 20.

In the photosensitive toners used in such a color image forming process, the respective ranges of wavelengths of light to which the three color photosensitive toners are sensitive must be separated from each other, so as to prevent mixing of colors in the produced image. For that purpose, three kinds of photosensitive toners, i.e., a yellow toner, a magenta toner, and a cyan toner, are used, which are respectively sensitive to different kinds of light having wavelengths in the ranges of 400 to 500 nm (blue light), 500 to 600 nm (green light), and 600 to 700 nm (red light). A conventional cyan-colored photosensitive toner which is sensitive to the light with wavelengths in the range of 600 to 700 nm usually contains a resinous binder, zinc oxide, and Bromophenol Blue as a sensitizing dye.

Although the above-mentioned photosensitive toner sensitized by Bromophenol Blue has high photosensitivity, it has a shortcoming in that its sensitivity range extends below the wavelength of 600 nm while showing hardly any sensitivity to the light with wavelengths in the range of 680 to 700 nm (this photosensitive toner exhibits the highest sensitivity to the light having wavelength of 620 nm). A red filter dye may be added to suppress the sensitivity of this photosensitive toner to the light of wavelengths below 600 nm. In this case, however, the electric charge-holding characteristic of the photosensitive toner deteriorates and the photosensitive toner mixture including such a toner takes on reddish color.

SUMMARY OF THE INVENTION

The photosensitive toner of this invention, which overcomes the above-discussed and numerous other disadvantages and deficiencies of the prior art, is a photosensitive toner sensitive to light with wavelengths in the range of 600 to 700 nm, including zinc oxide, a sensitizing dye, and a resinous binder, said sensitizing dye being a cyanine dye which is represented by the following general formula (I):

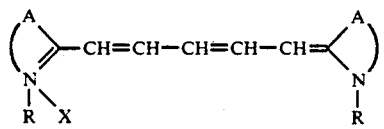

(I)

wherein 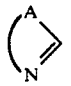 is

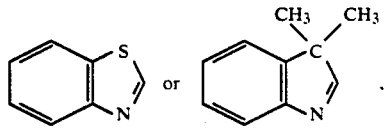

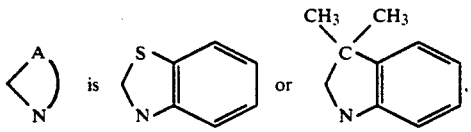

R is $CH_3$, $C_2H_5$, n-$C_4H_9$, n-$C_7H_{15}$, $CH_2COOH$, $C_2H_4COOH$ or allyl, and X is I, Cl, Br, $NO_3$ or tolylsulfonyl.

In a preferred embodiment, the amount of the cyanine dye is 0.05 to 0.5% by weight, based on the weight of the zinc oxide.

In a preferred embodiment, the cyanine dye is represented by the following general formula (II):

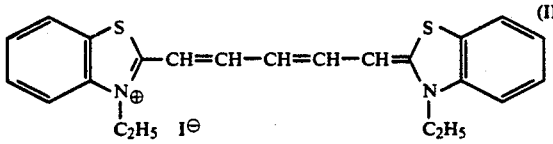

(II)

Thus, the invention described herein makes possible the objectives of (1) providing a photosensitive toner which has high uniform sensitivity to the light with wavelengths in the range of 600 to 700 nm and has hardly any sensitivity to the light having wavelengths below 600 nm; (2) providing a photosensitive toner capable of preventing the mixing of colors in a produced color image when used with other photosensitive toners colored magenta and yellow in a one-shot color image forming system; and (3) providing a photosensitive toner which has excellent electric charge-holding characteristic and does not impart a reddish color to the photosensitive toner mixture.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
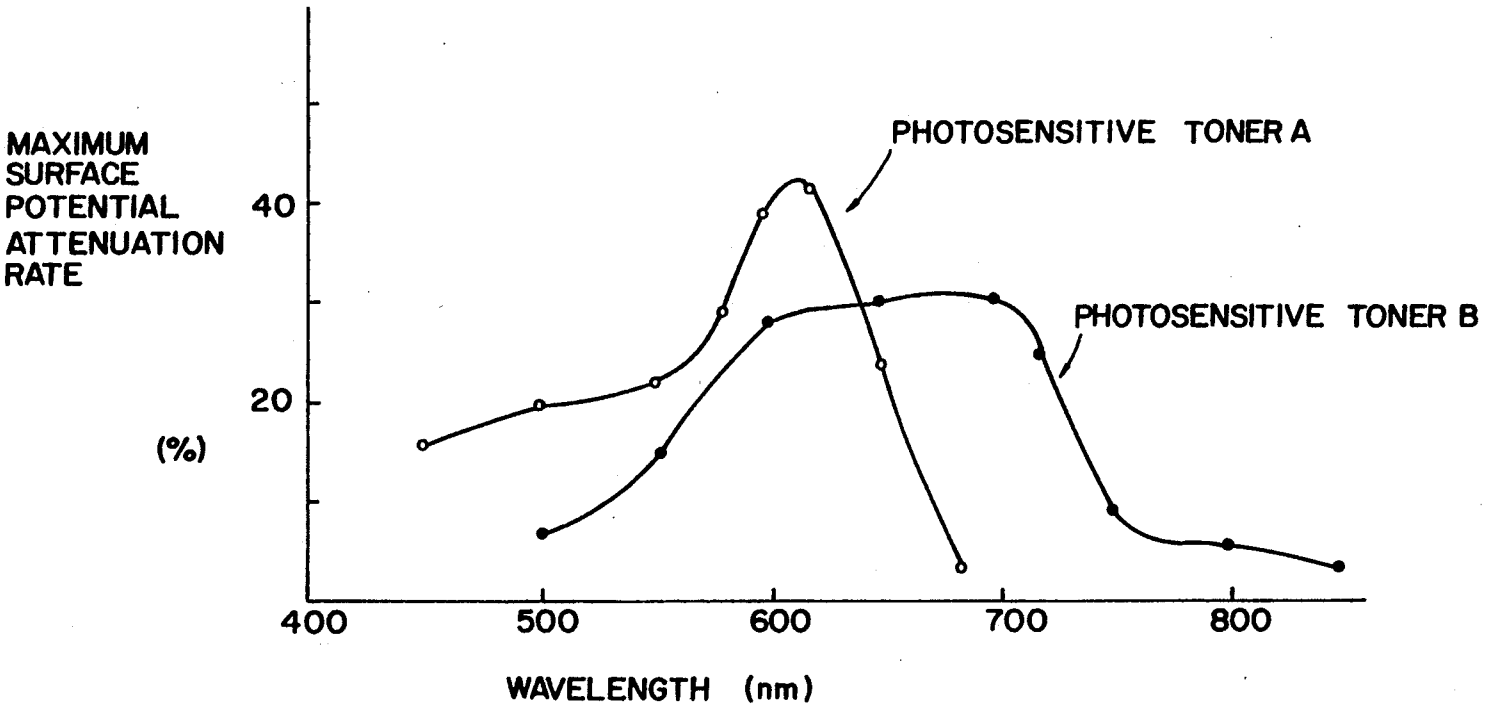
FIG. 1 is a graph showing the relationship between the wavelength and the maximum surface potential attenuation rate.
Figure 2:
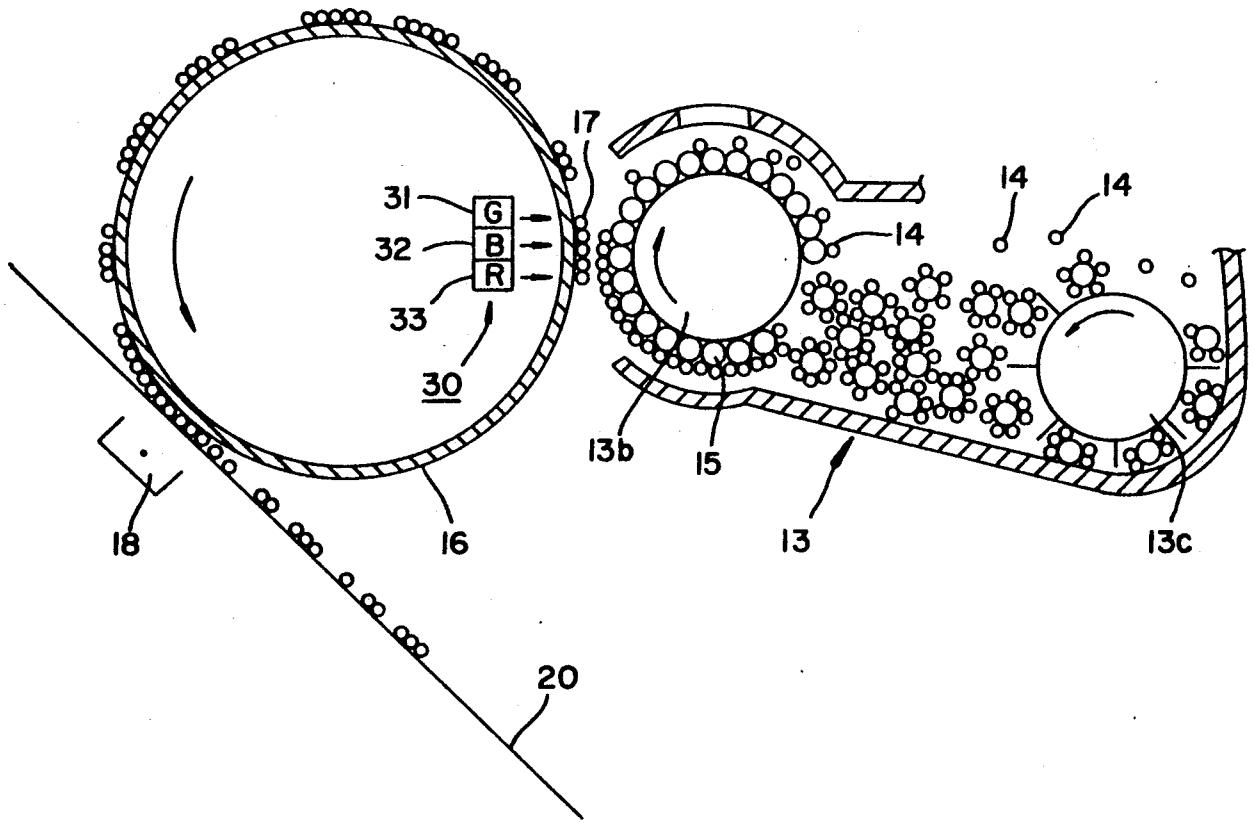
FIG. 2 is a schematic diagram showing the main part of a color image forming apparatus.

A photosensitive toner of the present invention contains an electrically insulating resinous binder, zinc oxide serving as a photoconductive material, and the aforementioned cyanine dye serving as a sensitizing dye. The photosensitive toner is prepared by dispersing and dissolving these materials in a solution and granulating the mixture by a grinding technique or a spray-dry technique.

As for the resinous binder, a known electrically insulating resin is used, examples of which include polymers such as styrene polymer, styrene-butadiene copolymer, styrene-acrylonitrile copolymer, styrene-maleic acid copolymer, acrylic polymer, styrene-acrylic copolymer, ethylene-vinyl acetate copolymer, polyvinylchloride, vinylchloride-vinyl acetate copolymer, polyester, alkyd resin, polyamide, polyurethane, acryl denatured urethane resin, epoxide resin, polycarbonate, polyarylate, polysulfone, diallyl phthalate resin, silicone resin, ketone resin, polyvinyl butyral resin, polyether resin, phenol resin, etc. Also, photoconductive resins such as polyvinylcarbazole, etc. can be used singly or in combination with electrically insulating resins.

Cyanine dyes which are commercially available and can be used as a sensitizing dye for the present invention include, for example, NK136 (produced by Nippon Kankoh Shikiso Kenkyusho Co., Ltd.). Either a single kind or different kinds of cyanine dyes can be used.

The amount of the zinc oxide is 3 to 600% by weight, and preferably 5 to 500% by weight, based on the weight of the resinous binder. If the quantity of the zinc oxide exceeds the above range, the electric charge-holding characteristic of the photosensitive toner tends to deteriorate. Conversely, if the quantity decreases below the above range, the toner sensitivity and the density of the resultant image tend to drop.

The amount of the cyanine dye is preferably 0.05 to 0.5% by weight, and preferably 0.1 to 0.2% by weight, based on the weight of the zinc oxide. If the quantity of the cyanine dye is greater than the above range, the electric charge-holding characteristic of the photosensitive toner tends to deteriorate, and the photosensitivity of the toner tends to drop slightly. On the other hand, if the quantity of the cyanine dye is below the above range, the effect that should be obtained by the addition of the cyanine dye will not be attained, i.e., such a small amount of cyanine dye cannot sensitize the photosensitive toner to a sufficient degree.

In addition to the above-mentioned components, the photosensitive toner may contain known offset inhibitors such as wax, etc., and assistants such as pressure fixing additives, etc., in accordance with known prescriptions.

A higher photosensitivity herein means a greater difference between the initial surface potential of the charged toner layer on the support drum and the surface potential of the toner layer measured after an exposure process (i.e., after the toner layer is exposed to light).

EXAMPLE

An example of the cyan-colored photosensitive toner of the present invention will be specifically described below, while referring to a conventional photosensitive toner as a comparative example.

COMPARATIVE EXAMPLE

Zinc oxide SOX100 (Trademark; produced by Seido Kagaku Co., Ltd.) ... 100 parts by weight
Bromophenol Blue ... 0.1 parts by weight
Styrene-acryl resin PA-525 (Trademark; Mitsui Toatsu Chemical Co., Ltd.) ... 33 parts by weight
Oil Red ... 0.3 parts by weight Toluene ... 1000 parts by weight The above materials were adequately mixed, and then subjected to a spray-dry process, resulting in a photosensitive toner A having an average particle size of 10 μm.

The photosensitive toner A was then mixed with ferrite carrier, and was electrically charged through friction, then charged photosensitive toner then being made to adhere uniformly to the surface of an aluminum board to form a toner layer thereon. Next, monochromatic light (400 nm to 850 nm) produced by a monochromator was radiated over the toner layer for 0.5 seconds. The surface potential before and 1.0 second after the radiation was measured, and then, from the obtained values, the attenuation rate of the surface potential (the maximum attenuation rate of the surface potential) was determined using a computer connected to a digital oscilloscope. The result is shown in FIG. 1.

EXAMPLE

A photosensitive toner B having an average particle size of 10 μm was prepared in the same manner as in Comparative Example, except that the cyanine dye NK136 (trademark; produced by Nippon Kankoh Shikiso Kenkyusho Co., Ltd.) represented by the following structural formula (II) was used instead by Bromophenol Blue and Oil Red, the quantity of the cyanine dye being 0.1% by weight based on the weight of the zinc oxide.

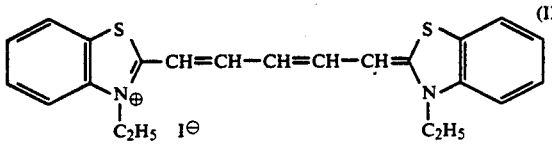

For the thus prepared photosensitive toner B, the maximum attenuation rate of the surface potential was measured in the same manner as in Comparative Example. The result is shown in FIG. 1.

As is apparent from FIG. 1, the photosensitive toner B containing the cyanine dye as a sensitizing dye showed a nearly uniform photosensitivity over the range of wavelengths of 600 to 700 nm. Moreover, the sensitivity of the photosensitive toner B showed a drastic drop for the wavelengths below 600 nm. Accordingly, this proves that the photosensitive toner B, which is a cyan toner of the present invention, does not cause mixing of colors in the resultant image when used in a one-shot color image forming system.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A cyan-colored photosensitive toner sensitive to light with wavelengths in the range of 600 to 700 nm, including zinc oxide, a sensitizing dye, and a resinous binder, said sensitizing dye being a cyanine dye which is represented by the following general formula (I):

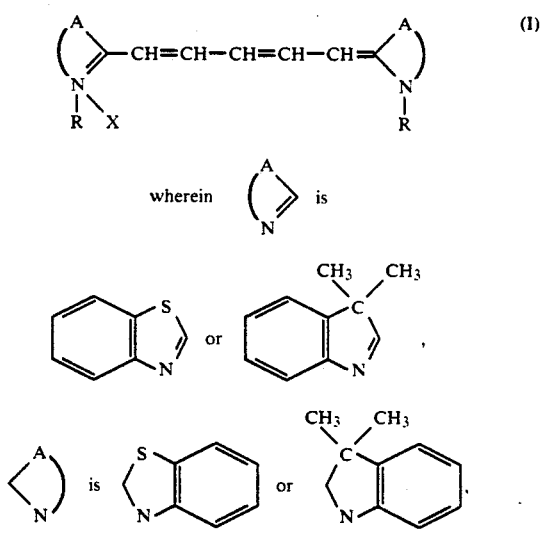

R is $CH_3$, $C_2H_5$, n-$C_4H_9$, n-$C_7H_{15}$, $CH_2COOH$, $C_2H_4COOH$ or allyl, and X is I, Cl, Br, $NO_3$ or tolylsulfonyl.

2. A cyan-colored photosensitive toner according to claim 1, wherein the amount of said cyanine dye is 0.05 to 0.5% by weight, based on the weight of said zinc oxide.

3. A cyan-colored photosensitive toner according to claim 1, wherein said cyanine dye is represented by the following general formula (II):

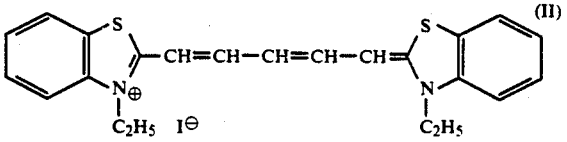

* * * * *